US006825809B2

(12) United States Patent
Aoki et al.

(10) Patent No.: US 6,825,809 B2
(45) Date of Patent: Nov. 30, 2004

(54) HIGH-FREQUENCY SEMICONDUCTOR DEVICE

(75) Inventors: Yoshio Aoki, Yamanashi (JP); Yutaka Mimino, Yamanashi (JP); Osamu Baba, Yamanashi (JP); Muneharu Gotoh, Yamanashi (JP)

(73) Assignee: Fujitsu Quantum Devices Limited, Yamanashi (JP)

( * ) Notice: Subject to any disclaimer, the term of this patent is extended or adjusted under 35 U.S.C. 154(b) by 0 days.

(21) Appl. No.: 10/090,612

(22) Filed: Mar. 6, 2002

(65) Prior Publication Data

US 2002/0140609 A1 Oct. 3, 2002

(30) Foreign Application Priority Data

Mar. 30, 2001 (JP) ..... 2001-099961

(51) Int. Cl.[7] ..... H01Q 1/36
(52) U.S. Cl. ..... 343/700 MS
(58) Field of Search ..... 343/700 MS, 702, 343/846; 257/24, 192

(56) References Cited

U.S. PATENT DOCUMENTS 5,006,859 A * 4/1991 Wong et al. ..... 343/700 MS
5,376,942 A * 12/1994 Shiga ..... 343/700 MS
5,392,152 A * 2/1995 Higgins et al. ..... 359/333
5,635,942 A * 6/1997 Kushihi et al. ..... 343/700 MS
5,703,601 A * 12/1997 Nalbandian et al. . 343/700 MS
5,903,239 A * 5/1999 Takahashi et al. ... 343/700 MS
6,005,520 A * 12/1999 Nalbandian et al. . 343/700 MS
6,469,326 B2 * 10/2002 Higuchi et al. ..... 257/192
6,556,169 B1 * 4/2003 Fukuura et al. ..... 343/700 MS

FOREIGN PATENT DOCUMENTS

| | | |
|---|---|---|
| JP | 5-55826 | 3/1993 |
| JP | 6-152237 | 5/1994 |
| JP | 8-56113 | 2/1996 |
| JP | 9-237867 | 9/1997 |
| JP | 9-284031 | 10/1997 |
| JP | 10-79623 | 3/1998 |

* cited by examiner

*Primary Examiner*—Tan Ho
(74) *Attorney, Agent, or Firm*—Westerman, Hattori, Daniels & Adrian, LLP

(57) ABSTRACT

A structure for eliminating the influence of an antenna line connected to the patch electrode on the antenna characteristics of a patch antenna built in an MMIC is disclosed. A through-hole is formed in the antenna ground plane which is provided under the patch electrode with an interlayer insulation film therebetween, the antena line is provided in the side opposite to the patch electrode with respect to the antena ground plane, and the patch electrode and antenna line are connected to each other with a conductor passing through the trough-hole.

21 Claims, 6 Drawing Sheets

HIGH-FREQUENCY SEMICONDUCTOR DEVICE

BACKGROUND OF THE INVENTION

1. Field of the Invention

The present invention relates to a high-frequency semiconductor device, particularly to the patch antenna provided in an MMIC (Monolithic Microwave Integrated Circuit).

2. Related Prior Art

MMICs comprising high-speed semiconductor devices such as represented by HEMT (High Electron Mobiliy Transistor) or HBT (Hetero-Bipolar Transistor) are provided with an antenna for receiving and transmitting signals from/to the outside. Antenna called patch antenna is known as what is easy to intergrate with MMICs.

FIG. 1 is a see-through plan view for explaining a conventional patch antenna, and FIG. 2 is a cross-sectional view taken on segment line A–A' in FIG. 1.

Referring to FIGS. 1 and 2, conventional patch antenna 100 has a structure comprising semiconductor substrate 1 provided with surface insulation film 2 protecting the surface thereof, antenna-ground plane 3 provided thereon, which is to be connected to the ground potential, and patch electrode 6 and antenna line 6*a* for supplying power to patch electrode 6 (or extracting power from patch electrode 6), both formed on antena-ground plane 3 with interlayer insulation film 5 therebetween.

The conventional patch antenna described with reference to FIGS. 1 and 2 can be formed from a planer metallization pattern, and easily integrated in an MMIC.

Patch electrode 6 corresponds to the feeding portion of the antenna, and its shape plays a substantial role in determining the characteristics of the antenna. However, it is necessary to connect antena line 6*a* to patch electrode 6, and this results in that the effective patch electrode has a shape of combining the respective patterns of patch electrode 6 and antenna line 6*a*. Thus, the conventional patch antenna necessarily includes the pattern of antenna line 6*a*, and the antenna characteristics, for example, radiation pattern, deviate from the ideal values obtained from the design based on only patch antenna 6.

SUMMARY OF THE INVENTION

It is an object of the present invention to provide an MMIC having a patch antenna with improved antenna characteristics.

It is another object of the present invention to provide a method for increasing freedom in a patch antenna pattern design.

It is still another object of the present invention to provide a method for preventing patch electrode from the influence of antenna line 6*a*.

FIG. 3 is a see-through plan view for explaining the essential concept of the presnt invention, and FIG. 4 is a cross-sectional view taken on segment line A–A' in FIG. 3.

As shown in the drawings, antenna line 6*a* as the antenna connection portion is formed under antenna ground plane 3, and is connected to the lower surface of patch electrode 6 via through-hole 7.

According to the present invention, antenna line 6*a* is not formed on the top surface of interlayer insulation films 5, and the pattern shape of patch electrode 6 can be free from antenna line 6*a*, and thus, the antenna characteristics can be improved.

DESCRIPTION OF THE PREFERRED EMBODIMENT

The embodiments of the present invention will be described in the following, with reference to drawings.

Figure 1:
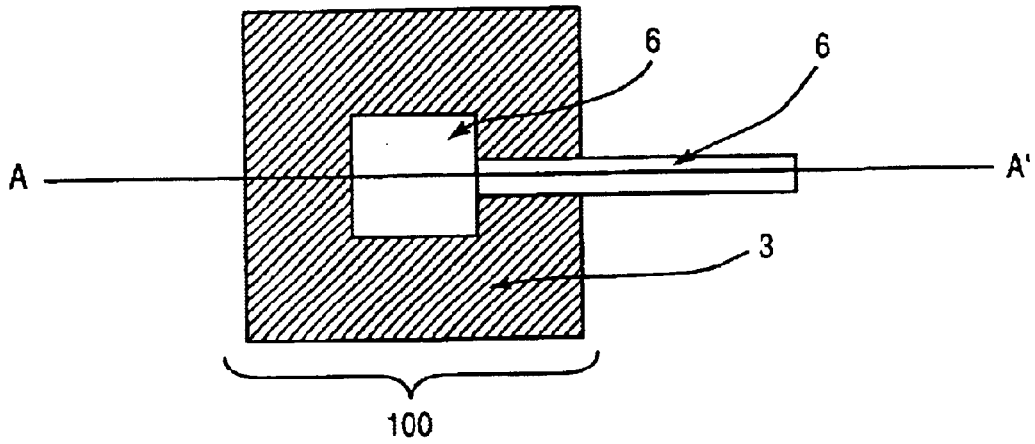
FIG. 1 PRIOR ART
FIG. 1 is a see-through plan view for explaining a conventional patch antenna.
Figure 2:
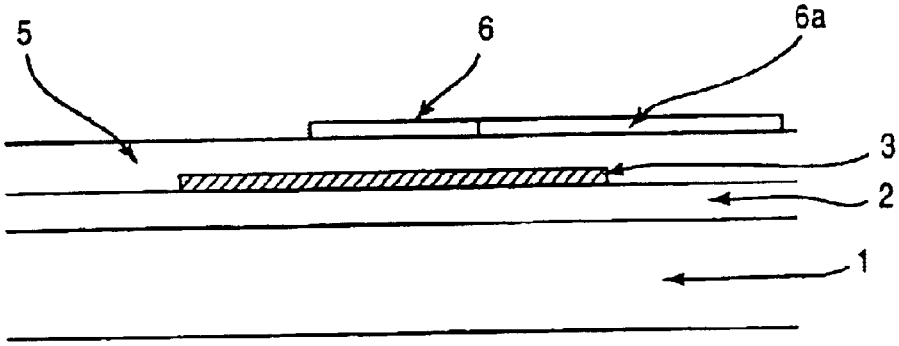
FIG. 2 PRIOR ART
FIG. 2 is a cross-sectional view taken on segment line A–A' in FIG.1.
Figure 3:
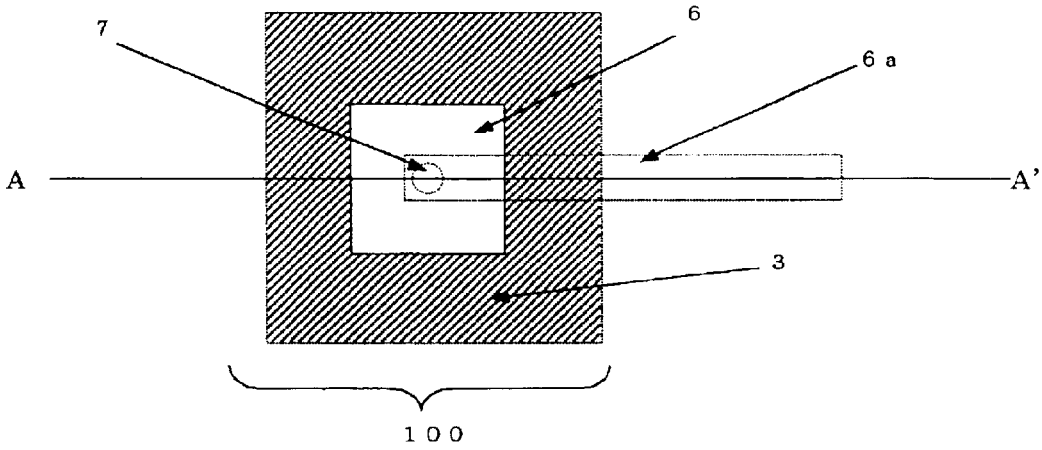
FIG. 3 is a see-through plan view for explaining the essential concept of the presnt invention.
Figure 4:
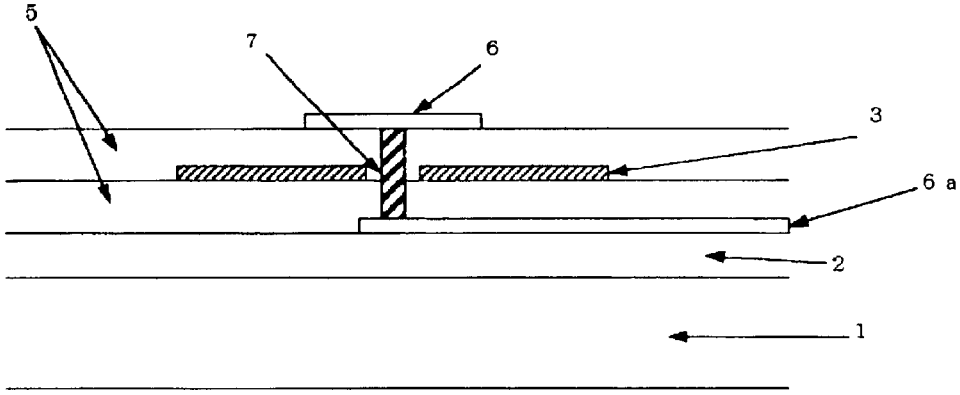
FIG. 4 is a cross-sectional view taken on segment line A–A' in FIG. 3.
Figure 5:
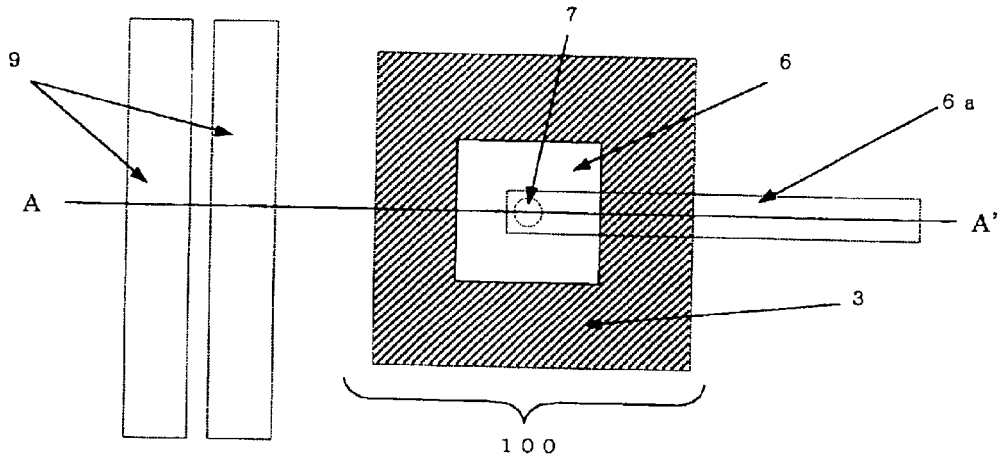
FIG. 5 is a see-through plan view for explaining the first emodiment of an MMIC according to the present invention.
Figure 6:
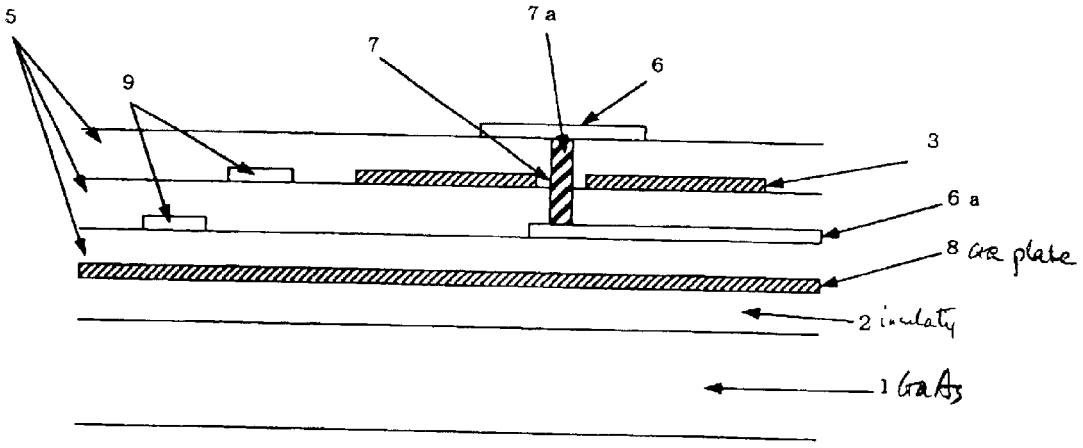
FIG. 6 is a cross-sectional view taken on segment line A–A' in FIG. 5.

FIG. 5 is a see-through plan view for explaining the first emodiment of an MMIC according to the present invention. FIG. 6 is a cross-sectional view taken on segment line A–A' in FIG. 5.

In this embodiment, GaAs compound semiconductor substrate 1 is employed, on which surface insulation film 2 composed of silicon nitride is provided after active devices such as FETs are built therein (not shown). Ground plate 8 composed of gold (Au) is formed on surface insulation film 2, which is connected to the ground potential via a not-shown wiring or through-hole, and further, antenna line 6*a*, antenna ground plane 3 which is connected to the ground potential, and patch electrode 6 are successively formed thereon with respective interlayer insulation films 5 therebetween. Antenna line 6*a* forms a high-frequency transmission line together with ground plate 8, and, line conductors 9 each forming a high-frequency transmission line together with ground plate 8 are formed in a region except that for patch antenna 100. Antenna line 6*a* and patch electrode 6 are interconnected by through-hole 7 passing through a cut-off pattern formed in antenna ground plane 3, and the electrical conduction is established by through-hole conductor 7*a*.

Each of interlayer insulation films 5 is composed of a polyimide or benzocyclobutene (BCB), and each of antenna line 6*a*, antenna ground plane 3, patch electrode 6 and line conductors 9 is composed of gold (Au) deposited by using a technology such as sputtering or vacuum deposition, and is patterned by using a technology such as ion milling or lift-off. Through-hole conductor 7*a* is formed of gold (Au) filled by using plating technology, for example.

According to this embodiment, there is no need for antenna line 6*a* and patch electrode 6 to be connected each other on a common surface, and antenna line 6*a* does not affect the pattern shape of patch electrode 6.

Figure 7:
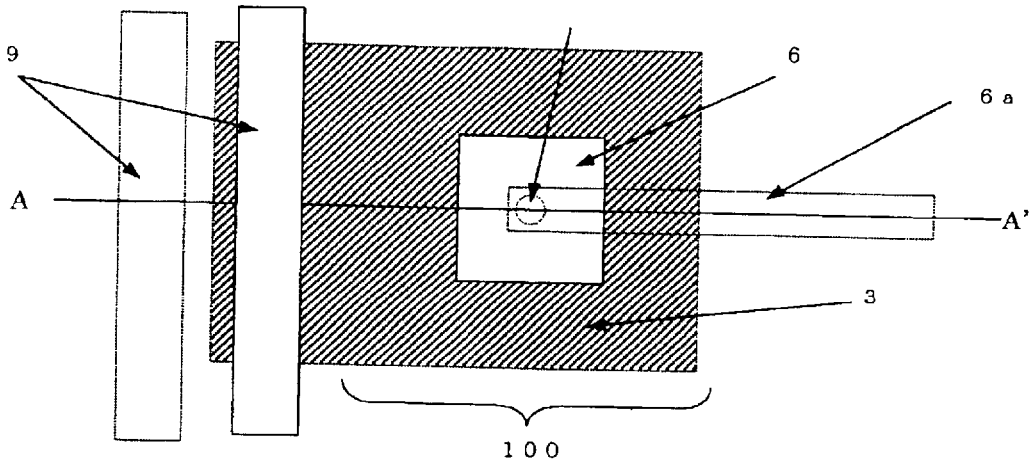
FIG. 7 is a see-through plan view for explaining the second emodiment of an MMIC according to the present invention.
Figure 8:
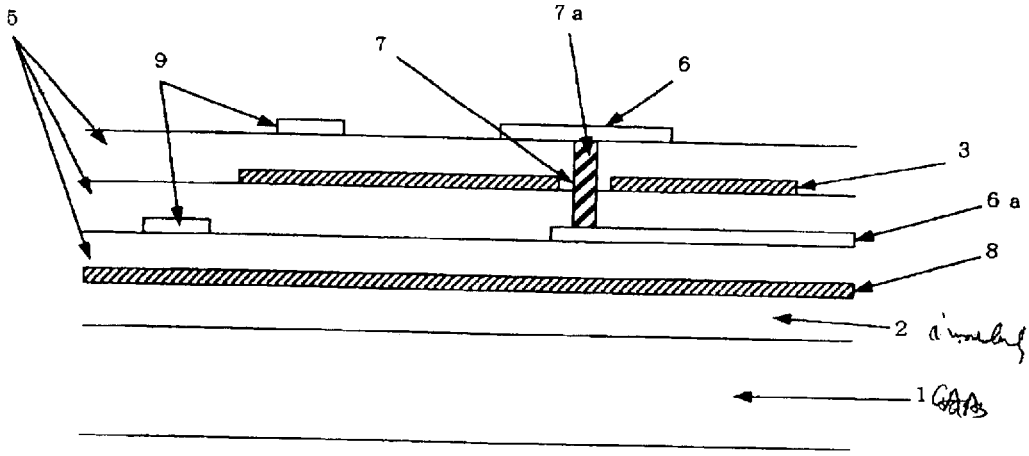
FIG. 8 is a cross-sectional view taken on segment line A–A' in FIG.7.

FIG. 7 is a see-through plan view for explaining the second emodiment of an MMIC according to the present invention, and FIG. 8 is a cross-sectional view taken on segment line A–A' in FIG.7.

In this embodiment, antenna ground plane 3 to be connected to the ground potential is widened up to the region where it has no longer any effect for functioning as antenna but can be used as a ground plate. That is, when a line conductor 9 is arranged over antenna ground plane 3 in such region with interlayer insulation film 5 therebetween, it can form a high-frequency transmission line together with the antenna ground plane 3.

Figure 9:
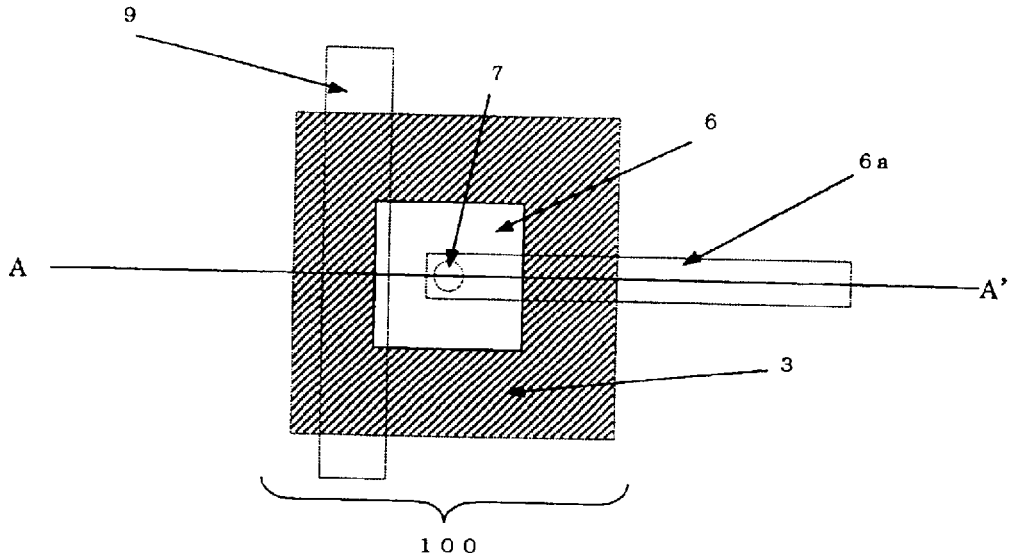
FIG. 9 is a see-through plan view for explaining the third emodiment of an MMIC according to the present invention.
Figure 10:
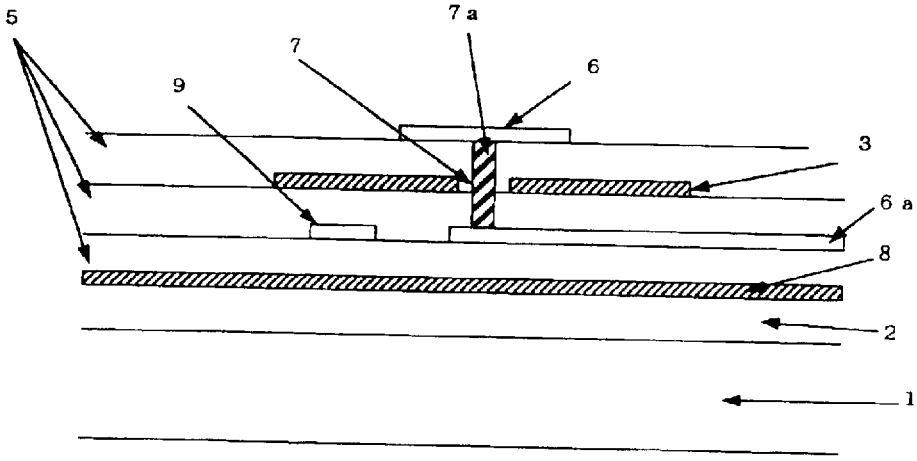
FIG. 10 is a cross-sectional view taken on segment line A–A' in FIG. 9.

FIG. 9 is a see-through plan view for explaining the third emodiment of an MMIC according to the present invention, and FIG. 10 is a cross-sectional view taken on segment line A–A' in FIG.9.

In this embodiment, line conductor 9 is formed under antenna ground plane 3. Antenna ground plane 3 is to be connected to the ground potential, and therefore, the antenna characteristics does not suffer from the structure under patch antenna 100, in particular, and the integration of MMICs can accordingly be facilitated by providing line conductors 9 under antenna ground plane 3. Besides line conductors, other passive devices (capacitor, inductor, and resistor) may be provided under antenna ground plane 3.

Figure 11:
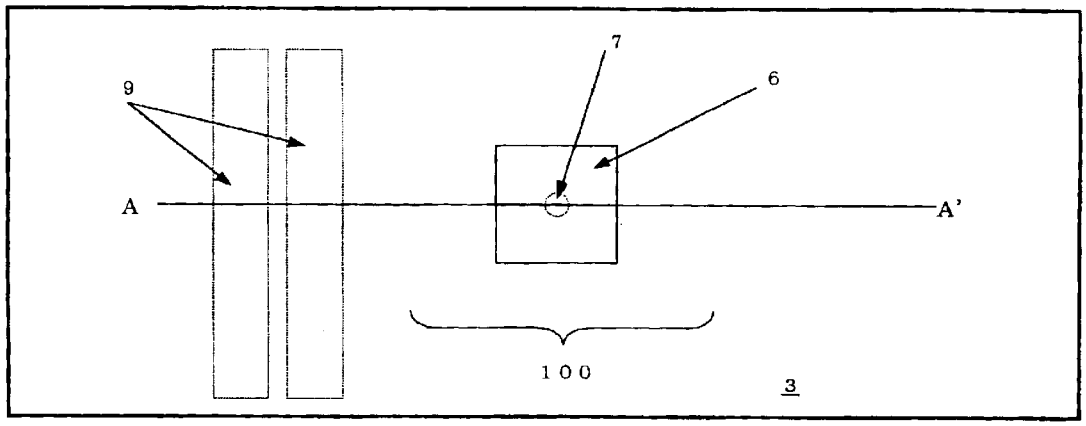
FIG. 11 is a see-through plan view for explaining the fourth emodiment of an MMIC according to the present invention.
Figure 12:
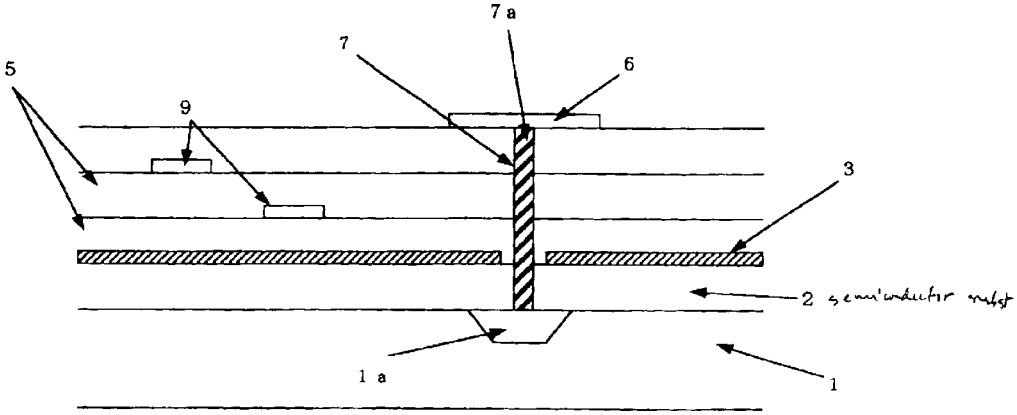
FIG. 12 is a cross-sectional view taken on segment line A–A' in FIG. 11.

FIG. 11 is a see-through plan view for explaining the fourth emodiiment of an MMIC according to the present invention, and FIG. 12 is a cross-sectional view taken on segment line A–A' in FIG.11.

In this embodiment, antenna ground plane 3 functions as the ground plane throughout an MMIC. That is, line conductors 9 are provided in a region where antenna ground plane 3 does not substantially influence on the antenna function, and antenna ground plane 3 functions as the ground plane of high-frequency transmission lines. Further in this embodiment, none of antenna line is employed, and active region 1*a* formed in semiconductor substrate 1 is used as an antenna connection.

According to this embodiment, antenna ground plane 3 is incidentally used as the ground plane, and the process for forming the ground plate can be omitted.

It should be understood that the present invention is not limited to those explained with reference to the above embodiments, and may reside in various modifications. Although a rectangular-shaped patch electrode, for instance, has been shown in the embodiments, the present invention may be applicable to a patch electrode having another shape such as circle, according to the several modes of applications, including the shape of the enclosure like package, the power feeding position, the need for plural power feedings, and so forth. Further, a conductor other than gold (Au) may be employed for the patch electrode and ground plane, in this regard, a super conductive material may be used.

According to the present invnetion, the antenna is not limited to a single patch antenna as explained above but may be composed of plural patch antennas disposed in a patch anetnna array, for instance.

As explained above, the present invention enables the pattern shape of a patch electrode to be free from the influence of an antenna line connected thereto, and therefore, a high-frequency semiconductor device having an antenna of excelent characteristics can be provided.

We claim:

1. A high-frequency semiconductor device comprising:

an antenna-ground plane provided above a semiconductor substrate, to be connected to a ground potential;

a patch electrode provided on said antenna-ground plane with an interlayer insulation film therebetween;

an antenna connection provided under said antenna-ground plane and connected to said patch electrode via a through-hole formed passing through said antenna-ground plane; and a line conductor provided on said antenna-ground plane with an interlayer insulation film therebetween, said line conductor forming a high-frequency transmission line together with said antenna-ground plane, wherein said antenna-ground plane is provided on a substantially entire surface of said semiconductor substrate.

2. A high-frequency semiconductor device as set forth in claim 1, wherein said antenna connection is an antenna line of a patterned conductor.

3. A high-frequency semiconductor device as set forth in claim 1, wherein said antenna connection is an active region formed in said semiconductor substrate.

4. A high-frequency semiconductor device as set forth in claim 1, wherein said interlayer insulation film is composed of a resin insulating material.

5. A high-frequency semiconductor device as set forth in claim 4, wherein said resin insulating material is a polyimide or benzocyclobutene.

6. A high frequency semiconductor device as set forth in claim 1, wherein said patch electrode has a rectangular shape or a circular shape.

7. A high-frequency semiconductor device as set forth in claim 1, wherein each of said patch electrode and antenna-ground plate is formed of a high conductive material.

8. A high frequency semiconductor device as set forth in claim 7, wherein said high conductive material is gold or a super conductor.

9. A high-frequency semiconductor device comprising:

an antenna-ground plane provided above a semiconductor substrate, to be connected to a ground potential;

a patch electrode provided on said antenna-ground plane with an interlayer insulation film therebetween;

an antenna connection provided under said antenna-ground plane and connected to said patch electrode via a through-hole formed passing through said antenna-ground plane; and a line conductor provided on said antenna-ground plane with an interlayer insulation film therebetween, said line conductor forming a high-frequency transmission line together with said antenna-ground plane, wherein said antenna-ground plane is formed to extend to up to a region in which said antenna-ground plane has no longer any effect for antenna functions, and said line conductor is provided on said antenna-ground plane in said region.

10. A high-frequency semiconductor device as set forth in claim 9, further comprising:

a ground plate provided between said antenna-ground plane and said semiconductor substrate and under said antenna connection, said ground plate being formed to extend over a substantially entire surface of said semiconductor substrate and to be connected to a ground potential; and another line conductor provided on said ground plate with an interlayer insulation film therebetween, said another line conductor forming a high-frequency transmission line together with said ground plate.

11. A high-frequency semiconductor device as set forth in claim 9, further comprising a passive device provided under said antenna-ground plane, said passive device being any one of line conductors, capacitors, inductors or resistors.

12. A high-frequency semiconductor device as set forth in claim 9, wherein said antenna connection is an antenna line of a patterned conductor.

13. A high-frequency semiconductor device as set forth in claim 9, wherein said interlayer insulation film is composed of a resin insulating material.

14. A high-frequency semiconductor device as set forth in claim 13, wherein said resin insulating material is a polyimide or benzocyclobutene.

15. A high-frequency semiconductor device as set forth in claim 9, wherein said patch electrode has a rectangular shape or a circular shape.

16. A high-frequency semiconductor device comprising:

an antenna-ground plane provided above a semiconductor substrate, to be connected to a ground potential;

a patch electrode provided on said antenna-ground plane with an interlayer insulation film therebetween;

an antenna connection provided under said antenna-ground plane and connected to said patch electrode via a through-hole formed passing through said antenna-ground plane;

a ground plate provided between said antenna-ground plane and said semiconductor substrate and under said antenna connection, said ground plate being formed to extend over a substantially entire surface of said semiconductor substrate and to be connected to a ground potential; and a line conductor provided on said ground plate with an interlayer insulation film therebetween, said line conductor forming a high-frequency transmission line together with said ground plate, wherein said antenna-ground plane and said line conductor are formed together on a common surface of said interlayer insulation film intervening between said line conductor and said ground plate.

17. A high frequency semiconductor device as set forth in claim 16, further comprising a passive device provided under said antenna-ground plane, said passive device being any one of line conductors, capacitors, inductors or resistors.

18. A high-frequency semiconductor device as set forth in claim 16, wherein said antenna connection is an antenna line of a patterned conductor.

19. A high-frequency semiconductor device as set forth in claim 16, wherein said interlayer insulation film is composed of a resin insulating material.

20. A high-frequency semiconductor device as set forth in claim 19, wherein said resin insulation material is a polyimide or benzocyclobutene.

21. A high-frequency semiconductor device as set forth in claim 16, wherein said patch electrode has a rectangular shape or a circular shape.

* * * * *